United States Patent [19]

Gaudioso

[11] Patent Number: 4,515,880

[45] Date of Patent: May 7, 1985

[54] REFLEX IMAGING PROCESS WITH MAGNETIC IMAGES

[75] Inventor: Stephen L. Gaudioso, Webster, N.Y.

[73] Assignee: Xerox Corporation, Stamford, Conn.

[21] Appl. No.: 190,112

[22] Filed: Sep. 24, 1980

[51] Int. Cl.[3] ..... G03G 19/00

[52] U.S. Cl. ..... 430/39; 148/103; 430/106.6; 346/74.2

[58] Field of Search ..... 430/39, 31

[56] References Cited

U.S. PATENT DOCUMENTS 3,555,557 1/1971 Nacci ..... 346/74

3,845,306 10/1974 Kohlmannsperger ..... 250/316

*Primary Examiner*—John D. Welsh

*Attorney, Agent, or Firm*—E. O. Palazzo

[57] ABSTRACT

Method of developing latent magnetic images obtained by reflex thermomagnetic recording. A reflex imaging member is magnetized and a latent magnetic image formed thereon by thermoremanent exposure. The imaging member is developed by contacting it with magnetizable toner particles which have been subjected to a high intensity magnetizing field such that the toner particles retain a residual internal magnetic field after removal of the magnetizing field.

10 Claims, No Drawings

REFLEX IMAGING PROCESS WITH MAGNETIC IMAGES

This invention relates to magnetic imaging, and more particularly, to a method of developing latent magnetic images obtained by reflex thermal demagnetization of premagnetized recording members.

PRIOR ART STATEMENT

As disclosed in U.S. Pat. No. 3,555,557, it is known to provide a process of reflex thermomagnetic recording by premagnetizing a magnetic recording member having a supprt transparent to light and particulate magnetic material opaque to light dispersed in discrete areas of the support. A document to be copied is placed in copying relationship with the recording member and light is directed through the recording member to the document and back to the recording member by imagewise reflection from the document. The light has an intensity sufficient to imagewise raise the temperature of the magnetic material in the recording member above the Curie temperature of the magnetic material and imagewise demagnetize it. The formed latent magnetic image may be read out repeatedly by such means as magnetooptic read-out, or the magnetic image may be treated with a magnetic ink or magnetic toner particles which adhere magnetically to the magnetized portions of the recording member. The magnetic ink or magnetic toner is then transferred to paper or suitable substrate to form a copy of the original document.

It is also known per U.S. Pat. No. 3,845,306 to produce a magnetic image of an original by applying to a uniformly premagnetized surface a thermal image wherein the temperature of certain portions exceeds the Curie point. Such magnetic images can be converted into power images by utilizing a magnetic toner. It is further known to subject a layer of magnetizable toner to the action of an external magnetic field and to simultaneously expose onto the magnetizable toner a thermal image wherein the temperature of certain portions exceeds the Curie point. This brings about a selective removal or transfer of pulverulent toner so that the residual toner or the removed toner forms a powder image. It has also been proposed to bring a magnetic layer in contact with a control layer wherein certain portions are heated above the Curie point to thus provide on the magnetic layer a permanent magnetic image of the original.

After formation, the latent magnetic image may be developed, that is, made visible by contact with magnetic marking material such as a magnetic toner composition. Subsequent to development of the latent magnetic image, it is usually desirable to transfer the toner inage from the magnetic imaging member to a permanent substrate such as paper. For this operation, there are basically two methods used in magnetographic printing. One method is by electrostatic means such as employing a corona device, and the other is pressure transfer. It has been found that pressure transferred images usually exhibit higher resolution than corona transferred images and offer a fusing advantage when fixed by flash or heat/pressure methods. In addition, higher transfer efficiency has been observed with the use of pressure. High transfer efficiencies are especially desirable when a wide variety of transfer substrates such as calendered papers, clay papers, and assorted plastics are used in the imaging process. However, most magnetic toner materials exhibit incomplete release or transfer from a magnetic imaging member, especially when using low transfer pressures.

In addition, the driving force for magnetic latent image development of reflex magnetic imaging members is significantly less than that for continuously coated magnetic media of similar thickness and composition. Consequently, the toner composition pile developed on reflex imaging members is generally sparser and more loosely held than for a comparable image developed on continuous media. Further, as the regions between the areas containing the magnetic particles are transparent, there are inherent regions of non-development with a reflex imaging member, even for solid area images. Therefore, reflex magnetic latent images tend to under-develop with conventional magnetic toners for the foregoing reasons. In addition, developed images obtained from low contrast input have very poor optical density. The underdevelopment is noticeably worsened when background toner removal procedures are employed. These deficiencies are particularly apparent for both fine line and solid area images.

Thus, it is an object of this invention to provide an improved method of developing reflex magnetic latent images.

It is a further object of this invention to provide an improved magnetic toner material for developing latent images on reflex magnetic imaging structures.

Another object of this invention is to provide a method of developing latent magentic images whereby denser developed images are obtained.

A further object of this invention is to provide a method of developing latent magnetic images whereby unwanted background toner deposits are reduced.

These and other objects of this invention will be apparent from a reading of the following description of the invention.

In accordance with the present invention, there is provided an improved method of developing latent magnetic images obtained in reflex thermoremanent magnetic imaging whereby superior duplicated images are produced. More specifially, it has been found that when a magnetic toner composition containing a magnetizable component having remanent magnetic properties is subjected to a D.C. magnetizing field having a magnetic strength of between about 200 gauss and about 5,000 gauss and then employed to develop magnetic latent images on a reflex imaging member, the resultant developed images are substantially improved over those obtained with non-magnetized toner particles of the same composition. The improvement is discernible by enhancement of solid area and line copy density as well as improved resolution of the images. In addition, the magnetized or "poled" toner composition behaves as a self-scavenger during development so that unwanted non-image or background toner deposits are also reduced. Further, the magnetized, or "poled", toner particles adhering to the developed image areas are removed to a lesser extent than non-magnetized or "unpoled" toner particles because they are held thereto more strongly than comparable magnetic, but non-magnetized, toner particles.

The method of obtaining the improved developed reflex magnetic latent images of this invention comprises the steps of thermally or otherwise erasing and subsequently magnetizing a reflex magnetic imaging member, placing a document to be copied in contact with the imaging member, directing light through the imaging member to the document to be copied and back to the imaging member by imagewise reflection from the document to expose the magnetic material in the imaging member and imagewise demagnetize the imaging member, separating the document to be copied from the imaging member, and contacting the imaging member with magnetizable toner particles which have been subjected to a high intensity D.C. magnetizing field such that the toner particles retain a residual internal magnetic field when the external magnetizing field is removed. For best results and economic considerations, it is preferred that the magnetizing field have a magnetic strength of between about 400 gauss and about 1200 gauss.

In operation, the reflex imaging member comprises a transparent support in the form of a film, base, or web having a series of parallel grooves which are filled with hard magnetic particles cemented to each other and to the support with a binder. More particularly, the preferred imaging member comprises a magnetic tape having a discretely patterned chromium dioxide recording surface as described in U.S. Pat. Nos. 3,522,090; 3,554,798; and 3,555,557, all assigned to the E. I. duPont Company, Wilmington, Del. The imaging member is uniformly magnetized in a directiion parallel to the preferred or "easy" magnetic axis. The premagnetized imaging member is held in contact by suitable means such as by vacuum with an original document to be copied and exposed with a suitable light source such as Xenon lamp at a flash energy of between about 1.5 joules and about 8.5 joules per square inch for between about 0.1 and about 10.0 milliseconds. The light source must be sufficient to raise the temperature of the magnetic particles in the imaging member above their Curie temperature. Chromium dioxide has a relatively low Curie temperature of about 125° C., and has a relatively high coercivity and high remanence. The remaining magnetized image areas form a latent magnetic image and attract the toner particles to form a visible image. The magnetically attractable component in the toner particles may be present in the amount of between about 20% by weight and about 90% by weight based on the weight of the toner composition. The developed image is then contacted with a receiving member to which pressure is applied and the image is thereby transferred thereto. Typically, the image transfer means comprises at least a pair of transfer rollers or a transfer roller and an idler roller. After transfer of the image to the receiving member, the image is fixed thereto. Any fixing method can be employed. Typical suitable fixing methods include heating the toner in the developed image to cause the resins thereof to at least partially melt and become adhered to the receiving member, the application of pressure to the toner being optionally accomplished with heating such as the use of a heated roller, solvent or solvent vapor to at least partially dissolve the resin component of the toner, or any combination of the above. The receiving member is typically sufficiently hard to allow fixing solely by the application of pressure such as, for example, by a contact roller in an amount sufficient to calender the toner. These techniques are conventional in the art of fixing of toner and need not be elaborated upon herein.

The magnetizable toner composition utilized for development of the magnetic latent image preferably comprises a resinous material that can be fused to a receiving medium when brought into contact therewith under heat and pressure such as by a heated roller. It will be understood that fixing need not occur at a transfer station but can optionally be provided down stream. In that case, a separate fusing station having conventional fusing means can be employed. While the receiving medium may be fed from a supply roll, it will be appreciated that the receiving medium can be provided in any form, e.g., sheet, strip, web, etc.

Subsequent to transfer of the toner from the latent magnetic image to the receiving medium, the imaging member may be passed adjacent to an erase means suitably energized by a power source prior to re-magnetization. Further, the imaging member may be provided in the form of an endless web or tape traveling over rollers.

Any suitable development technique can be employed for the development of the magnetic latent image residing in the imaging member. Typical suitable development methods include cascade development, powder cloud development, and flood development. It will be appreciated, of course, that, if electrostatic transfer techniques are employed, the toner utilized at the development station comprises an electrostatically attractable component.

Any suitable magnetizable toner composition may be employed in the imaging method of this invention. Typical magnetizable toner compositions include an electrostatically attractable component such as gum copal, gum sandarac, cumarone-indene resin, asphaltum, gilsonite, phenolformaldehyde resins, resin-modified phenolformaldehyde resins, methacrylic resins, polystyrene resins, epoxy resins, polyester resins, polyethylene resins, vinyl chloride resins, and copolymers or mixtures thereof. The particular toner material to be employed may be selected depending upon its triboelectric properties where such is a consideration. However, it is preferred that the toner material be selected from polyhexamethylene sebacate and polyamide resins as they have excellent fixing properties. Among the patents describing toner compositions are U.S. Pat. No. 2,659,670 issued to Copley; U.S. Pat. No. 2,753,308 issued to Landrigan; U.S. Pat. No. 3,070,342 issued to Insalaco; U.S. Pat. No. Re. 25,136 to Carlson, and U.S. Pat. No. 2,782,288 issued to Rheinfrank et al. These toners generally have an average particle diameter in the range substantially 5 to 30 microns, however, 5 to 15 microns is preferred.

Any suitable pigment or dye may be employed as a colorant for the toner particles. Colorants for toners are well known and are, for example, carbon black, black dye such as Nigrosine dyes, aniline blue, Calco Oil Blue, chrome yellow, ultramarine blue, Quinoline Yellow, methylene blue chloride, Monastral Blue, Malachite Green Oxalate, lampblack, Rose Bengal, Monastral Red, Sudan Black BN, and mixtures thereof. The pigment or dye should be present in the toner in a sufficient quantity to render it highly colored so that it will form a clearly visible image on a recording member.

Any suitable magnetic or magnetizable substance may be employed as the magnetically attractable component for the toner particles. Typical magnetically attractable materials include metals such as iron, nickel, cobalt, ferrites containing nickel, zinc, cadmium, barium, and manganese; metal oxides such as $CrO_2$, $\gamma$-$Fe_2O_3$, and $Fe_3O_4$; metal alloys such as nickel-iron, nickel-cobalt-iron, aluminum-nickel-cobalt, copper-nickel-cobalt, and cobalt-platinum-manganese. Preferred for the instant process are particulate hard magnetic materials such as an iron oxide, preferably $\gamma$-

$Fe_2O_3$, and $Fe_3O_4$, ferrites such as barium ferrite, and $CrO_2$, acicular iron-cobalt alloys, which have a coercivity of at least about 40 Oersteds and exhibit a remanence of at least about 20 percent of their saturation magnetization as they are black in color and provide excellent magnetic properties for the process of this invention. Generally, the magnetic component particles may range in size from about 0.02 micron to about 1 micron. A preferred average particle size for the magnetic component particles is from about 0.1 to about 0.5 micron average diameter. The magnetic component particles may be any shape, including acicular or polyhedral.

The following examples further define and describe the magnetic imaging method of the present invention to develop latent magnetic images. Parts and percentages are by weight unless otherwise indicated.

EXAMPLE I

A magnetizable toner composition was prepared as follows. To about 38 pounds of a solvent mixture comprising about 4 parts of chloroform and about 6 parts of hexane was added about 0.7 pounds of polyhexamethylene sebacate, a linear polyester, and about 1.3 pounds of an uncoated magnetite pigment available under the tradename MAPICO Black from the Columbian Division of Cities Services Inc., Akron, Ohio. The polyester was prepared by bulk polymerizing a mixture comprising about 38 parts of 1,6-hexanediol and about 62 parts of sebacic acid in the presence of about 0.1 part/hundred of lead acetate. The mixture was heated and the temperature maintained at about 425° F. until the reaction was substantially complete. The polyester product had an intrinsic viscosity of about 0.8 deciliter per gram by measurements in toluene at about 25° C.

The dispersion was milled for about 30 minutes at ambient temperature and then transferred to a gravity feed kettle. The mixture was fed onto a 2 inch diameter spinning disc atomizer at a rotation speed of about 50,000 r.p.m. using a commercial spray dryer. The feed rate was about 200 ml. per minute. The inlet drying temperature was held at about 180° F. The spray-dried particles were passed through a cyclone separator and collected in a bell jar. After drying overnight in a vacuum oven, the particles were screened through an 84 μm screen to remove agglomerates. The spray-dried toner particles were found to have a volume median diameter of about 12 microns and a geometric standard deviation of about 1.43. The number median diameter of the toner particles was about 5.7 microns with a geometric standard deviation of about 1.74.

The toner composition comprised about 65 parts of magnetite and about 35 parts of polyhexamethylene sebacate. The toner material was dry-blended with about 0.4 parts by weight of a flow agent additive commercially available under the tradename Silanox® 101 from Cabot Corporation, Boston, Mass., to provide a free-flowing, magnetic developer material. Silanox® 101 is a hydrophobic fumed silicon dioxide.

A segment of magnetizable reflex imaging material obtained from the duPont Company was thermally erased and subsequently magnetized with a D.C. field having a magnetic strength of about 1000 gauss. The uniformly premagnetized imaging member was held in contact by vacuum with an original to be copied comprising a sheet of white paper containing black line and solid area print thereon and exposed with a Xenon flash lamp at an energy of about 4 joules per square inch for about 1.0 milliseconds. The original to be copied was separated from the imaging member and the imaging member was flooded with the foregoing developer composition to develop the latent magnetic image formed on the imaging member. The imaging member was then "sandwiched" between 2 sheets of Xerox® 1024 paper and passed between two 3" diameter steel rolls using about 65 pli pressure at a speed of about 5 inches/second. The magnetic developer material was transferred to the receiving sheet. Upon examination, it was found that the copied image had poor solid area and line density. The copied image was also dull and had poor resolution.

EXAMPLE II

The procedure of Example I was repeated except that the developer composition was magnetized with a D.C. field having a magnetic strength of about 1000 gauss prior to contacting it with the imaging member to develop the latent magnetic image formed thereof. The imaging member was then "sandwiched" between 2 sheets of Xerox® 1024 paper and the developed image transferred to the receiving sheet as in Example I. Upon examination, it was found that the copied image contained much less toner deposit in the image background areas, solid area development was much better, and significantly sharper images were obtained.

EXAMPLE III

A magnetizable toner composition was prepared as follows. To about 87.5 pounds of chloroform was added about 9.375 pounds of an uncoated magnetic pigment available under the tradename Pfizer magnetite MO4232 from Pfizer, Inc., of Easton, Pa., and about 3.125 pounds of a polyamide resin commercially available under the tradename Emerez 1552 from Emery Industries, Inc. of Cincinnati, Ohio. Emerez 1552 is a solid polyamide material derived from the reaction of a dimer acid with a linear diamine.

The dispersion was milled for about 30 minutes at ambient temperature and then transferred to a gravity feed kettle. The mixture was fed onto a spinning disc atomizer at a rotation speed of about 50,000 r.p.m. using a commercial spray dryer. The feed rate was about 200 ml. per minute. The inlet drying temperature was held at about 180° F. The spray-dried particles were passed through a cyclone separator and collected in a bell jar. After drying overnight in a vacuum oven, the particles were screened through an 84 μm screen to remove agglomerates. The spray-dried toner particles were found to have a volume median diameter of about 13.3 microns and a geometric standard deviation of about 1.59. The number median diameter of the toner particles was about 5.2 microns with a geometric standard deviation of about 1.80.

The toner composition comprised about 75 parts by weight of magnetite and about 25 parts by weight of the polyamide. The toner material was dry-blended with about 0.4 parts by weight of a flow agent additive commercially available under the tradename Silanox® 101 from Cabot Corporation, Boston, Mass., to provide a free-flowing, magnetic developer material. Silanox® 101 is a hydrophobic fumed silicon dioxide.

A segment of magnetizable reflex imaging material obtained from the duPont Company was thermally erased and subsequently magnetized with a D.C. field having a magnetic strength of about 1000 gauss. The uniformly permagnetized imaging member was held in contact by vacuum with an original to be copied comprising a sheet of white paper containing black line and solid area print thereon and exposed with a Xenon flash lamp at an energy of about 4 joules per square inch for about 1.0 milliseconds. The original to be copied was separated from the imaging member and the imaging member was flooded with the foregoing developer composition to develop the latent magnetic image formed on the imaging member. The imaging member was then "sandwiched" between 2 sheets of Xerox® 1024 paper and passed between two 3" diameter steel rolls using about 65 pli pressure at a speed of about 5 inches/second. The magnetic developer material was transferred to the receiving sheet. Upon examination, it was found that the copied image had poof solid area and line density. The copied image was also dull and had poor resolution.

EXAMPLE IV

The procedure of Example III was repeated except that the developer composition was magnetized with a D.C. field having a magnetic strength of about 1000 gauss prior to contacting it with the imaging member to develop the latent magnetic image formed thereon. The imaging member was then "sandwiched" between 2 sheets of Xerox® 1024 paper and the developed image transferred to the receiving sheet as in Example III. Upon examination, it was found that the copied image contained much less toner deposit in the image background areas, solid area development was much better, and significantly sharper images were obtained.

EXAMPLE V

A magnetizable toner composition commercially available as Nashua M-203 from Nashua Corporation, Nashua, N.H., comprising about 60 parts of a magnetic component and about 40 parts of a polyethylene resin was employed in this example.

A segment of magnetizable reflex imaging material obtained from the duPont Company was thermally erased and subsequently magnetized with a D.C. field having a magnetic strength of about 1000 gauss. The uniformly premagnetized imaging member was held in contact by vacuum with an original to be copied comprising a sheet of white paper containing black line and solid area print thereon and exposed with a Xenon flash lamp at an energy of about 4 joules per square inch for about 1.0 milliseconds. The original to be copied was separated from the imaging member and the imaging member was flooded with the foregoing toner composition to develop the latent magnetic image formed on the imaging member. The imaging member was then "sandwiched" between 2 sheets of Xerox® 1024 paper and passed between two 3" diameter steel rolls using about 65 pli pressure at a speed of about 5 inches/second. The magnetic toner material as transferred to the receiving sheet. Upon examination, it was found that the copied image had poor solid area and line density. The copied image was also dull and had poor resolution.

EXAMPLE VI

The procedure of Example V was repeated except that the developer composition was magnetized with a D.C. field having a magnetic strength of about 1000 gauss prior to contacting it with the imaging member to develop the latent magnetic image formed thereon. The imaging member was then "sandwiched" between 2 sheets of Xerox® 1024 paper and the developed image transferred to the receiving sheet as in Example V. Upon examination, it was found that the copied image contained much less toner deposit in the image background areas, solid area development was much better, and significantly sharper images were obtained.

In summary, it has been found and shown that the imaging method of this invention provides significantly improved developed images obtained in reflex thermomagnetic recording systems.

Although specific materials and conditions are set forth in the foregoing examples, these are merely intended as illustrations of the present invention. Various other suitable resins, imaging members, magnetic substances, additives, pigments, colorants, and/or other components may be substituted for those in the specification with similar results. Other materials may also be added to the toner to sensitize, synergize or otherwise improve the fusing properties or other properties of the system.

Other modifications of the present invention will occur to those skilled in the art upon a reading of the present disclosure. These are intended to be included within the scope of this invention.

I claim:

1. A method of developing latent magnetic images obtained by reflex thermomagnetic recording comprising the steps of:

(a) erasing and then magnetizing a reflex imaging member having a support transparent to light and particulate hard magnetic material opaque to said light dispersed in discrete areas bound to said support;

(b) placing a document to be copied in contact with said imaging member;

(c) directing light through said imaging member to said document and back to said imaging member by imagewise reflection from said document to expose said magnetic material in said imaging member and imagewise demagnetize said imaging member;

(d) separating said document from said imaging member; and (e) contacting said imaging member with magnetizable toner particles which have been subjected to a D.C. magnetizing field having a magnetic strength of between about 200 gauss and about 5,000 gauss whereby said toner particles retain a residual internal magnetic field after removal of said magnetizing field.

2. A method of developing latent magnetic images in accordance with claim 1 wherein said imaging member comprises a magnetic tape having a discretely patterned chromium dioxide recording surface.

3. A method of developing latent magnetic images in accordance with claim 1 wherein said imaging member is uniformly magnetized in a direction parallel to the magnetic axis of said imaging member.

4. A method of developing latent magnetic images in accordance with claim 1 wherein said imaging mbmer is exposed with a flash energy of between about 1.5 joules and about 8.5 joules per square inch for between about 0.1 and about 10.0 milliseconds.

5. A method of developing latent magnetic images in accordance with claim 1 wherein said magnetizable toner particles comprise a fixable resinous material and a magnetically attractable component.

6. A method of developing latent magnetic images in accordance with claim 5 wherein said resinous material is selected from polyhexamethylene sebacate, polyamide and polyethylene resins.

7. A method of developing latent magnetic images in accordance with claim 5 wherein said magnetically attractable component is selected from the group consisting of $\gamma$-$Fe_2O_3$, $Fe_3O_4$, ferrites, iron-cobalt alloys, and $CrO_2$.

8. A method of developing latent magnetic images in accordance with claim 1 including transferring the developed magnetic image from said imaging member to a receiving substrate.

9. A method of developing latent magnetic images in accordance with claim 8 including fixing the transferred developed image to said receiving substrate.

10. A method of developing latent magnetic images in accordance with claim 6 wherein the resin is a polyester material prepared from 1,6 hexanediol and sebacic acid.

* * * * *